US011130354B2

(12) United States Patent
Saitoh

(10) Patent No.: US 11,130,354 B2
(45) Date of Patent: Sep. 28, 2021

(54) LIQUID DISCHARGE APPARATUS

(71) Applicant: Ricoh Company, Ltd., Tokyo (JP)

(72) Inventor: Haruki Saitoh, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/872,913

(22) Filed: May 12, 2020

(65) Prior Publication Data

US 2020/0376856 A1 Dec. 3, 2020

(30) Foreign Application Priority Data

May 30, 2019 (JP) ..... JP2019-101813

(51) Int. Cl.
*B41J 11/00* (2006.01)

(52) U.S. Cl.
CPC ..... *B41J 11/002* (2013.01)

(58) Field of Classification Search
CPC .... B41J 11/002; B41J 2/2142; B41J 2203/01; G01N 21/86
See application file for complete search history.

(56) References Cited

U.S. PATENT DOCUMENTS

| | | | | |
|---|---|---|---|---|
| 2007/0058019 | A1 | 3/2007 | Saitoh et al. | |
| 2009/0290007 | A1 | 11/2009 | Saitoh et al. | |
| 2013/0250017 | A1 | 9/2013 | Saitoh et al. | |
| 2013/0293625 | A1* | 11/2013 | Massen | B41J 2/04561 347/19 |
| 2015/0077493 | A1 | 3/2015 | Saitoh | |
| 2015/0138287 | A1 | 5/2015 | Saitoh | |
| 2015/0258811 | A1 | 9/2015 | Hiratsuka et al. | |
| 2015/0258813 | A1 | 9/2015 | Saitoh et al. | |
| 2016/0096377 | A1 | 4/2016 | Katoh et al. | |

FOREIGN PATENT DOCUMENTS

| | | |
|---|---|---|
| JP | 2007-105927 A | 4/2007 |
| JP | 2011-161795 A | 8/2011 |
| JP | 2011-212906 | 10/2011 |
| JP | 2013-203801 | 10/2013 |

* cited by examiner

*Primary Examiner* — Bradley W Thies
(74) *Attorney, Agent, or Firm* — Xsensus LLP

(57) ABSTRACT

A liquid discharge apparatus includes a liquid discharge head and a window. The liquid discharge head discharges a liquid onto a recording medium to form an image. The window is near the liquid discharge head. The image on the recording medium is visually recognizable through the window.

8 Claims, 5 Drawing Sheets

LIQUID DISCHARGE APPARATUS

CROSS-REFERENCE TO RELATED APPLICATION

This patent application is based on and claims priority pursuant to 35 U.S.C. § 119(a) to Japanese Patent Application No. 2019-101813, filed on May 30, 2019, in the Japan Patent Office, the entire disclosure of which is incorporated by reference herein.

BACKGROUND

Technical Field

Aspects of the present disclosure relate to a liquid discharge apparatus.

Discussion of the Background Art

In printing requiring high-level color reproduction, waste of a sheet and an ink may occur due to repeated correction of output colors.

For example, in order to check a printing state during printing, there has been proposed a configuration in which printing is interrupted and a placement table on which a recording medium is placed is moved to a position where the placement table can be visually checked.

SUMMARY

In an aspect of the present disclosure, there is provided a liquid discharge apparatus includes a liquid discharge head and a window. The liquid discharge head discharges a liquid onto a recording medium to form an image. The window is near the liquid discharge head. The image on the recording medium is visually recognizable through the window.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
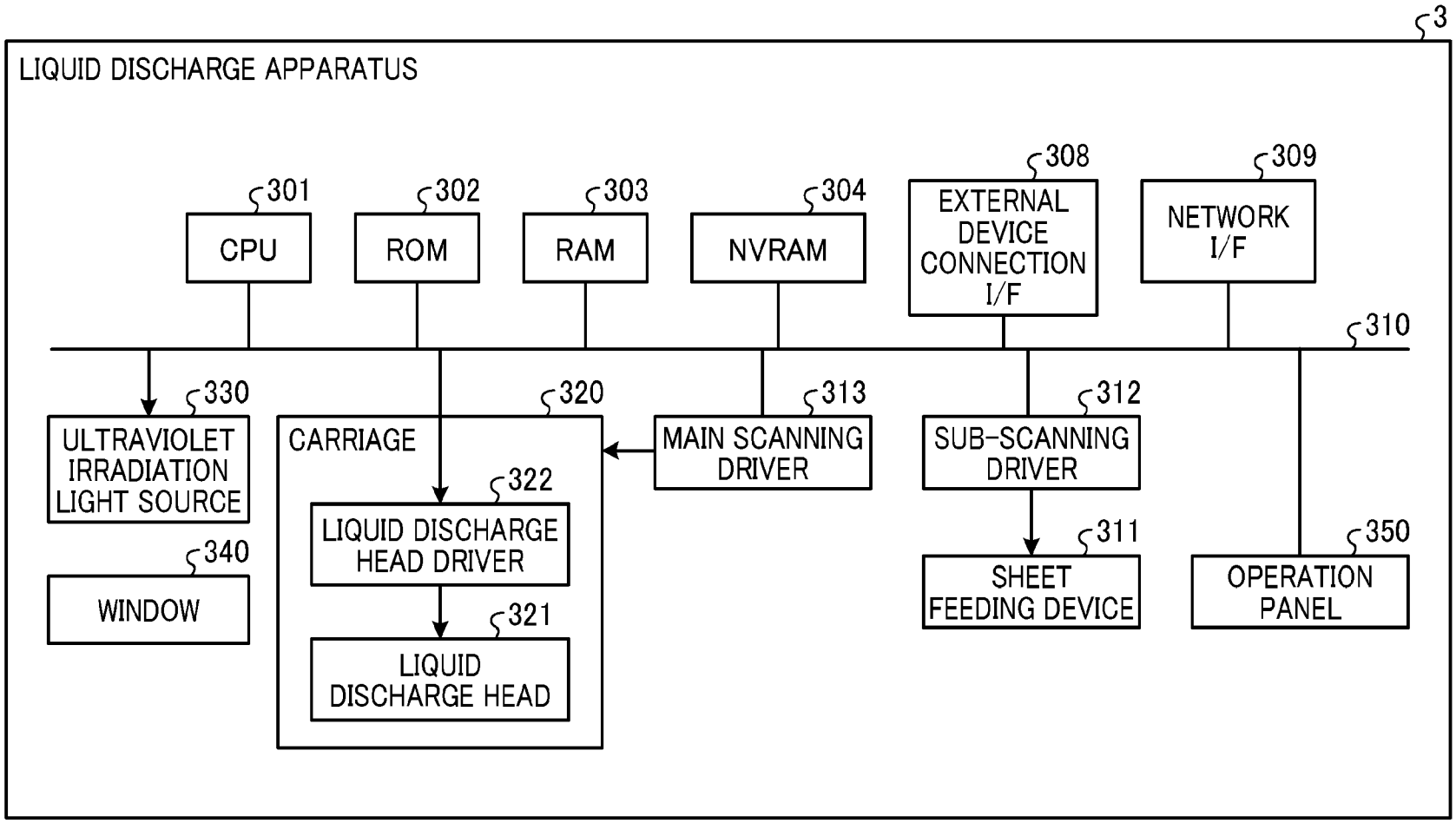
FIG. 1 is a diagram illustrating an example of a configuration of a liquid discharge apparatus according to an embodiment.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Hereinafter, the best mode for carrying out the disclosure will be described with reference to the drawings.

Embodiment

The configuration of the embodiment will be described with reference to FIGS. 1 and 2.

Configuration Example of Liquid Discharge Apparatus

Figure 2:
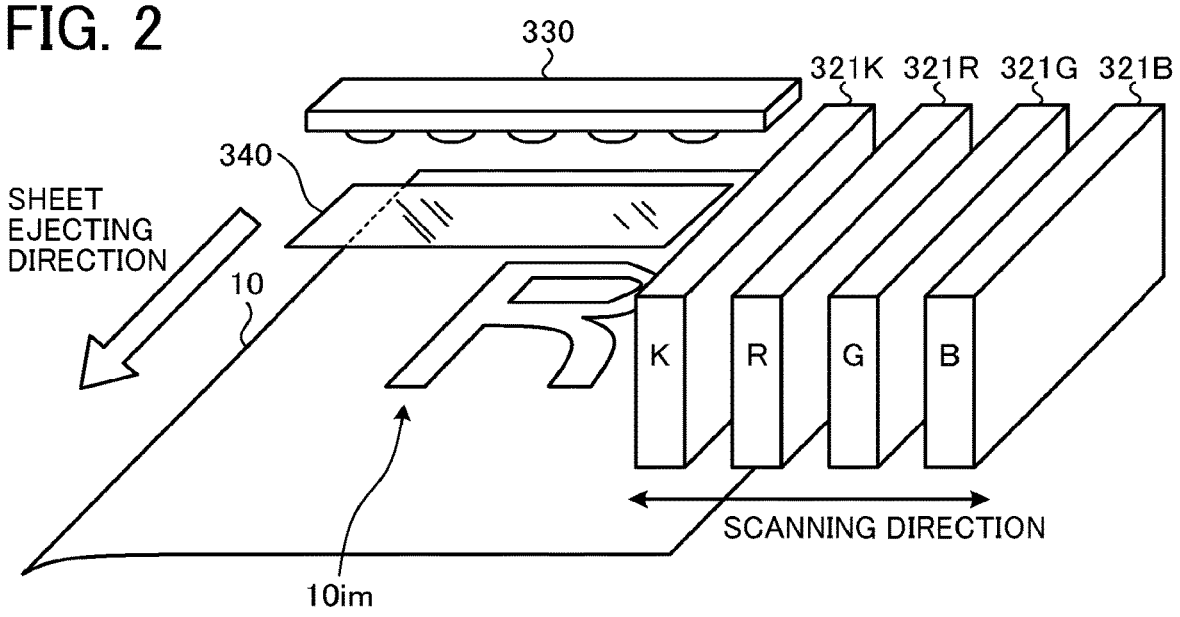
FIG. 2 is a schematic diagram illustrating an example of a detailed configuration around a carriage of the liquid discharge apparatus of FIG. 2.

FIG. 1 is a diagram illustrating an example of a configuration of a liquid discharge apparatus 3 according to the embodiment. The liquid discharge apparatus 3 is, for example, an inkjet printer that discharges a liquid such as inks of three colors of cyan, magenta, and yellow (CMY) which are three primary colors or inks of three colors of red, green, and blue (RGB) which are three primary colors of light, and forms an image on a surface of a printing sheet or the like. Of these, the inks of RGB colors which are three primary colors of light may be, for example, ultraviolet-excited fluorescent inks.

As illustrated in FIG. 1, the liquid discharge apparatus 3 includes a central processing unit (CPU) 301, a read only memory (ROM) 302, a random access memory (RAM) 303, a non-volatile random access memory (NVRAM) 304, an external device connection interface (I/F) 308, a network I/F 309, and a bus line 310. The liquid discharge apparatus 3 further includes a sheet feeding device 311, a sub-scanning driver 312, a main scanning driver 313, a carriage 320, an ultraviolet irradiation light source 330, a window 340, and an operation panel 350.

The CPU 301 controls operation of the entire liquid discharge apparatus 3. The ROM 302 stores, for example, a program used for driving the CPU 301, such as an initial program loader (IPL). The RAM 303 is used as a work area of the CPU 301. The NVRAM 304 stores various types of data such as a program, and holds the various types of data even while the power of the liquid discharge apparatus 3 is cut off.

The external device connection I/F 308 is connected to a personal computer (PC) by a universal serial bus (USB) cable or the like, and communicates control signals and data to be printed with the PC. The network I/F 309 is an interface for performing data communication using a communication network such as the Internet. The bus line 310 is an address bus, a data bus, or the like for electrically connecting each component such as the CPU 301.

The sheet feeding device 311 includes, for example, a roller and a motor for driving the roller, and feeds a printing sheet in a sub-scanning direction along a feeding path in the liquid discharge apparatus 3. The sub-scanning driver 312 controls movement of the sheet feeding device 311 in the sub-scanning direction. The main scanning driver 313 controls movement of the carriage 320 in a main scanning direction.

The carriage 320 includes a liquid discharge head 321 and a liquid discharge head driver 322. The liquid discharge head 321 has a plurality of nozzles for discharging a liquid such as an ink, and is mounted on the carriage 320 such that discharge surfaces (nozzle surfaces) of the nozzles face a printing sheet side. By discharging a liquid onto a printing sheet intermittently fed in the sub-scanning direction while moving in the main scanning direction, the liquid discharge head 321 discharges the liquid to a predetermined position on the printing sheet to form an image. The liquid discharge head driver 322 is a driver for controlling driving of the liquid discharge head 321.

The ultraviolet irradiation light source 330 is disposed, for example, near an upper part of the carriage 320 and irradiates a surface of a printing sheet on which an image is formed with ultraviolet light. The above-described ultraviolet-excited fluorescent ink is substantially colorless and transparent under visible light such as room light. When an image on a printing sheet is formed using the ultraviolet-excited fluorescent ink, the ultraviolet irradiation light source 330 excites the ultraviolet-excited fluorescent ink by ultraviolet irradiation to visualize the image.

The window 340 is disposed near the ultraviolet irradiation light source 330, and is configured such that an image formed on a printing sheet can be visually recognized from the outside of the liquid discharge apparatus 3. When the image on the printing sheet is formed using the ultraviolet-excited fluorescent ink, an image visualized by ultraviolet light emitted from the ultraviolet irradiation light source 330 is visually recognized.

The operation panel 350 includes a touch panel for displaying a current setting value, a selection screen, and the like, and receiving input from an operator, an alarm lamp, and the like.

Note that the liquid discharge head driver 322 may have a configuration in which the liquid discharge head driver 322 is not mounted on the carriage 320 but is connected to the bus line 310 outside the carriage 320. Each of the main scanning driver 313, the sub-scanning driver 312, and the liquid discharge head driver 322 may be implemented by an instruction of the CPU 301 according to a program.

Configuration Example Around Carriage

Next, a detailed configuration around the carriage 320 of the liquid discharge apparatus 3 will be described with reference to FIG. 2. FIG. 2 is a schematic diagram illustrating an example of a detailed configuration around the carriage 320 of the liquid discharge apparatus 3 according to the present embodiment.

As described above, the carriage 320 includes the liquid discharge head 321. In the liquid discharge apparatus 3, an image is printed on a printing sheet 10 as a recording medium by, for example, reciprocating the carriage 320 right and left.

Here, it is assumed that the liquid discharge apparatus 3 discharges ultraviolet-excited fluorescent inks of RGB colors which are three primary colors of light to form an image. In this case, the carriage 320 includes liquid discharge heads 321R, 321G, and 321B that discharge ultraviolet-excited fluorescent inks of three colors of RGB, respectively, and a liquid discharge head 321K (key plate) that discharges a black ink for visible information.

When an ultraviolet-excited fluorescent ink which is substantially invisible under room light is output as an image by inkjet printing using the liquid discharge head 321, a combination of at least three colors of RGB which are three primary colors of light is required in order to obtain a full color image. This is in principle the same as that a cathode ray tube, a liquid crystal display, an organic electro-luminescence (EL) display, a light emitting diode (LED) display, or the like causes cells of three colors of RGB to emit light to display a full color image.

In full color printing using an ordinary ink, information of RGB which are three primary colors of light is subjected to complicated numerical conversion inside the apparatus, and then an image is formed using inks of CMY which are three primary colors. Therefore, in order to apply RGB inks that emit fluorescence by irradiation with ultraviolet excitation light and is based on three primary colors of light to the full color printing, a cyan ink is replaced with a red ink, a magenta ink is replaced with a green ink, and a yellow ink is replaced with a blue ink by utilizing a fact that CMY and RGB have a complementary color relationship, and a positive original image is converted into a negative image using image editing software or the like to invert hue and brightness. When the negative image thus converted is printed in an inkjet manner, an output image close to the positive original image is obtained. Furthermore, also due to a development technique of raster image processor (RIP) software and a printer driver for RGB ink output, an image with good color reproducibility is obtained.

However, in image formation by inkjet printing as in the liquid discharge apparatus 3, ink droplets are caused to fly by the liquid discharge head 321 and are caused to land on a recording medium such as a printing sheet such that ink droplets of different colors overlap each other. Therefore, unlike a case where an independent cell is caused to emit light as in the above-described display, an image is formed on the premise of mixing colors of inks of different colors. In image formation using the ultraviolet-excited fluorescent ink, it is originally possible to form an image on the premise of mixing three primary colors of light in inkjet printing for forming an image on the premise of mixing three primary colors.

These liquid discharge heads 321R, 321G, 321B, and 321K are arranged in parallel with each other, for example, in a direction orthogonal to an extending direction of the liquid discharge heads 321R, 321G, 321B, and 321K, that is, in a direction in which the printing sheet 10 is ejected, are scanned on a surface of the printing sheet 10 in a direction orthogonal to the ejection direction of the printing sheet 10, and print an image on the printing sheet 10.

The ultraviolet irradiation light source 330 is disposed near an upper part of the liquid discharge heads 321K, 321R, 321G, and 321B. The ultraviolet irradiation light source 330 is configured in a ribbon shape in which, for example, a plurality of LEDs that emits ultraviolet light is arranged on a support. More specifically, the ultraviolet irradiation light source 330 is disposed at a position where the printing sheet 10 on which an image 10*im* is being printed can be irradiated with ultraviolet light above an area where the liquid discharge heads 321K, 321R, 321G, and 321B are scanned on the printing sheet 10 in a direction orthogonal to an extending direction of the liquid discharge heads 321K, 321R, 321G, and 321B.

Generally, in the carriage 320, the liquid discharge heads 321K, 321R, 321G, and 321B, an ink tank, and a cartridge only need to be within a predetermined height, and there is almost no extra space around the carriage 320. For example, a distance between the carriage 320 and a top plate above the carriage 320 is about several mm to about several tens mm. By forming the ultraviolet irradiation light source 330 in a ribbon shape, the ultraviolet irradiation light source 330 can be disposed near an upper part of the carriage 320 having such a narrow gap.

As a result, the ultraviolet irradiation light source 330 irradiates the printing sheet 10 on which an image is being formed and which has not been ejected out of the liquid discharge apparatus 3 with ultraviolet light, and can cause the image 10*im* printed on the printing sheet 10 to emit light using the ultraviolet-excited fluorescent ink to visualize the image 10*im*.

The ultraviolet light emitted from the ultraviolet irradiation light source 330 has a wavelength of preferably not less than 315 nm and not more than 400 nm, more preferably not less than 350 nm and not more than 380 nm, and has a peak wavelength of, for example, 365 nm. As a result, excitation energy suitable for fluorescence emission can be given to a general fluorescent dye of the ultraviolet-excited fluorescent ink.

Illuminance of ultraviolet light emitted from the ultraviolet irradiation light source 330 on the printing sheet 10 is not less than 0.1 $mW/cm^2$ and not more than 2.0 $mW/cm^2$, and more preferably not less than 0.5 $mW/cm^2$ and not more than 2.0 $mW/cm^2$, as measured by an ultraviolet illuminometer having a measurement wavelength peak of 360 nm. When the illuminance is less than 0.1 $mW/cm^2$, the fluorescence emission intensity by a general fluorescent dye of the ultraviolet-excited fluorescent ink is weak, and as described later, when an operator checks the image 10*im*, it is difficult to perceive a difference in output color, color omission due to nozzle clogging, and the like. When the illuminance is higher than 2.0 $mW/cm^2$, the fluorescence emission intensity by the fluorescent dye may be too strong and a color tone may look different.

The window 340 is disposed near the ultraviolet irradiation light source 330. More specifically, the window 340 is disposed at a position where the image 10*im* being printed on the printing sheet 10 can be visually recognized in a state of being visualized by irradiation with ultraviolet light from the ultraviolet irradiation light source 330 between the ultraviolet irradiation light source 330 and a scanning area of the liquid discharge heads 321K, 321R, 321G, and 321B.

The window 340 is made of, for example, a transparent resin that transmits visible light and blocks ultraviolet light. More specifically, the window 340 is made of, for example, polycarbonate or polymethyl methacrylate. Polycarbonate and polymethyl methacrylate have a blocking effect of 95% or more against ultraviolet light having a wavelength of not less than 350 nm and not more than 380 nm. Note that it is more preferable to use polymethyl methacrylate having higher transparency out of polycarbonate and polymethyl methacrylate.

As a result, an operator can check the image 10*im* on the printing sheet 10 before the printing sheet 10 is ejected out of the liquid discharge apparatus 3. At this time, the operator visually checks whether a printed image has a desired color, whether color omission due to nozzle clogging has occurred, and the like. When a printing defect or the like has occurred, the operator only needs to immediately take measures such as stopping printing.

Note that it is also possible to cause the liquid discharge apparatus 3 to discharge inks of three colors of CMY which are three primary colors to form an image. In this case, it is only required to set the three liquid discharge heads 321 for discharging visible inks of three colors of CMY, respectively, and the liquid discharge head 321K for discharging a black ink. At this time, the above-described liquid discharge heads 321R, 321G, and 321B can be cleaned and used as the CMY liquid discharge heads 321.

Comparative Example

A concealed image, a code, or the like for preventing tampering or forgery is attached to a passport, a vehicle verification, a cash card, bills, and the like by a special printing technique. The concealed image, the code, and the like cannot be checked under visible light, and cannot be read by a scanner. In such a special printing technique, a single color invisible ink is generally used, and full color printing, gradation, and the like cannot be expressed.

Utilizing such a special printing technique, a technique is known in which inkjet printing is performed using a substantially colorless and transparent ultraviolet-excited fluorescent ink under room light, and a hidden image is printed on a sheet which is seen as a white sheet at first glance. An ink jet system can implement full color printing relatively easily using inks of three primary colors of light, and can also print a hidden image for preventing tampering or forgery. Furthermore, it is considered that light is emitted like an image on a monitor of a PC, and graphic printing with a high eye catching property can also be performed.

However, in printing using such an invisible ink, whether there is a printing defect, for example, whether an image is output as desired or whether color omission due to nozzle clogging has occurred, cannot be checked visually at an initial stage when a printing operation starts. For this reason, a printing sheet and an expensive ink may be wasted without notice even if there is a printing defect such as an image failure. In particular, in a wide-width inkjet printer that consumes a large amount of ink, such as AO size poster printing, such a problem is more significant.

Here, as a comparative example, a configuration is considered in which printing is interrupted in order to visually check a printing state during printing, and a placement table on which a recording medium is placed is moved to a position where the placement table can be visually checked.

However, the comparative example requires a large and complicated mechanism. With an ultraviolet irradiation means for curing an ink included in the configuration of the comparative example, a printing status of an invisible ink cannot be checked during printing. For this reason, when inkjet printing is performed using a substantially colorless and transparent ultraviolet-excited fluorescent ink under room light, whether there is a defect, for example, whether an output image during printing has a desired color or whether color omission due to nozzle clogging has occurred cannot be found at an early stage, and wasteful consumption of an ink or a sheet cannot be suppressed.

The liquid discharge apparatus 3 of the embodiment includes the ultraviolet irradiation light source 330 and the window 340. As described above, a printing state of an image can be checked at an early stage before a printing sheet is ejected without making a major change to the liquid discharge apparatus 3. When an operator notices a defect such as an abnormal output color or color omission, the operator immediately stops the printing operation, and for example, corrects an output color, cleans the liquid discharge head 321, and the like to be able to perform restoration and reprinting. As a result, resources such as a printing sheet and an ink can be saved. In addition, time required for image check can be reduced.

According to the liquid discharge apparatus 3 of the embodiment, the window 340 functions as a safety cover. That is, an operator can check a printing state in the liquid discharge apparatus 3 without a risk of touching a mechanically operating unit.

According to the liquid discharge apparatus 3 of the embodiment, the window 340 is made of polycarbonate or polymethyl methacrylate acrylate that blocks ultraviolet light. As a result, an operator is not likely to be exposed to ultraviolet light which may cause skin tanning, spots, and wrinkles and may have an adverse effect on the eyes, and can visually check a printing state while the operator is close to the ultraviolet irradiation light source 330.

According to the liquid discharge apparatus 3 of the embodiment, the wavelength of ultraviolet light emitted from the ultraviolet irradiation light source 330 is preferably not less than 315 nm and not more than 400 nm, and more preferably not less than 350 nm and not more than 380 nm. By using ultraviolet light in the wavelength range as excitation light, excitation energy suitable for fluorescence emission of a general invisible fluorescent dye can be given to the ultraviolet-excited fluorescent ink.

According to the liquid discharge apparatus 3 of the embodiment, illuminance of ultraviolet light received by a printing sheet on which an image is formed is not less than 0.1 $mW/cm^2$ and not more than 2.0 $mW/cm^2$, and more preferably not less than 0.5 $mW/cm^2$ and not more than 2.0 $mW/cm^2$, as measured by an ultraviolet illuminometer having a measurement wavelength peak of 360 nm. By adjusting the illuminance of ultraviolet light within the above range, it is easy to perceive a difference in output color and color omission in visual check.

According to the liquid discharge apparatus 3 of the embodiment, the ultraviolet irradiation light source 330 has a ribbon shape in which a plurality of LEDs is arranged. This can reduce installation space of the ultraviolet irradiation light source 330. In addition, ultraviolet light can be emitted without using a large-sized and heat-generating device such as a fluorescent tube type ultraviolet lamp, and for example, it is possible to suppress various defects caused by stagnant heat in the liquid discharge apparatus 3.

Note that even when the liquid discharge apparatus 3 ejects inks of three colors of CMY which are three primary colors to form an image, an image output status to a printing sheet can be checked in a timely manner with the window 340. In this case, the ultraviolet irradiation light source 330 does not have to emit ultraviolet light.

EXAMPLES

Examples will be described with reference to FIGS. 3 to 5.

Example 1

In order to optimize the wavelength of irradiation light of the ultraviolet irradiation light source installed in the liquid discharge apparatus, the present inventor checked a peak of emission intensity of each phosphor included in the RGB ultraviolet-excited fluorescent inks while changing an excitation wavelength.

First, a maximum emission peak of each phosphor used in evaluation was measured using a spectrofluorometer FP-6500 manufactured by JASCO Corporation, and the peaks for Red, Green, and Blue were 615 nm, 525 nm, and 445 nm, respectively. Even when the excitation wavelength of ultraviolet light was changed, these peak positions did not shift, and the emission intensity changed. Therefore, the excitation wavelength was changed while the emission wavelength of each phosphor included in the RGB ultraviolet-excited fluorescent inks was observed in a fixed manner, and the peak of the emission intensity was checked. FIG. 3 illustrates the result.

Figure 3:
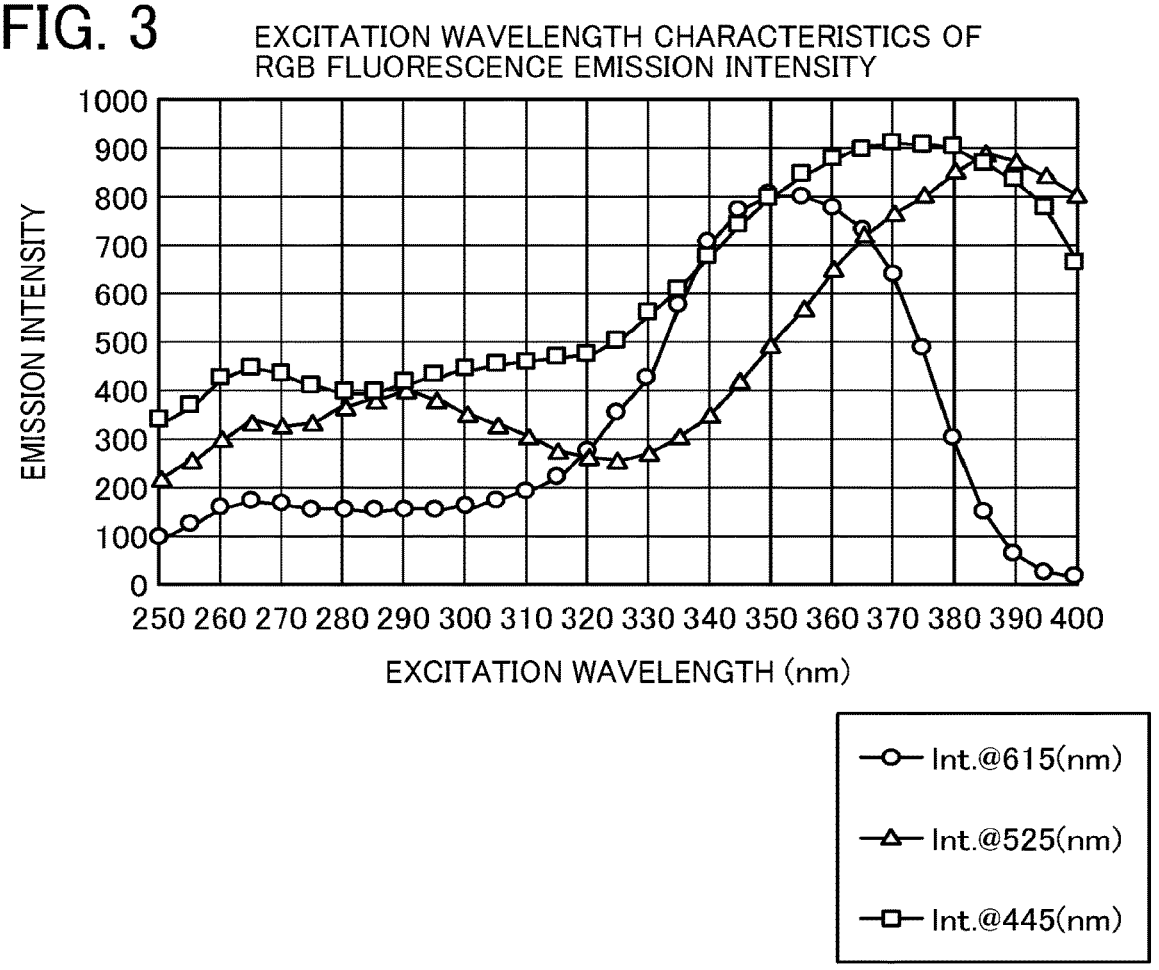
FIG. 3 is a graph of a peak of an emission intensity obtained by changing an excitation wavelength while observing an emission wavelength of a phosphor included in red, green, and blue (RGB) ultraviolet-excited fluorescent inks according to Example 1 in a fixed manner.

FIG. 3 is a graph of a peak of an emission intensity obtained by changing an excitation wavelength while an emission wavelength of a phosphor included in the RGB ultraviolet-excited fluorescent inks according to Example 1 was observed in a fixed manner. The horizontal axis of the graph of FIG. 3 indicates the excitation wavelength (nm) of light emitted to a phosphor, and the vertical axis indicates the emission intensity of the phosphor.

As illustrated in FIG. 3, the peaks of the emission intensity for Red, Green, and Blue were 355 nm, 385 nm, and 370 nm, respectively. That is, at these wavelengths, each phosphor emits the brightest light. As described above, the peak points were different among the RGB phosphors. In particular, the Red phosphor was excited on a short wavelength side, and emitted almost no light even when being excited near 400 nm which is an end of an ultraviolet (UV)-A band.

From the distribution of the RGB excitation wavelength characteristics as described above, it has been found that the three colors emit light in a well-balanced manner within a range of not less than 350 nm and not more than 380 nm. However, the shortest wavelength of a currently commercially available LED that emits ultraviolet light is 365 nm. The wavelength of 365 nm is also located at the center of an excitation wavelength band in which the three colors emit light in a well-balanced manner. For this reason, it is considered that an even more preferable excitation wavelength is 365 nm. Note that a fluorescent lamp type blue black light had good color reproducibility when FL20BLB having a main wavelength of 365 nm and manufactured by Toshiba Lighting & Technology Corporation was used as an excitation light source.

Example 2

In order to optimize the illuminance of ultraviolet light at the time of visually judging the color and the color omission of an image printed with the ultraviolet-excited fluorescent ink, the present inventor irradiated an actual image with fluorescent lamp type blue black light. FIG. 4 is a schematic diagram illustrating a state in which illuminance of the fluorescent lamp type blue black light according to Example 2 is measured.

Figure 4:
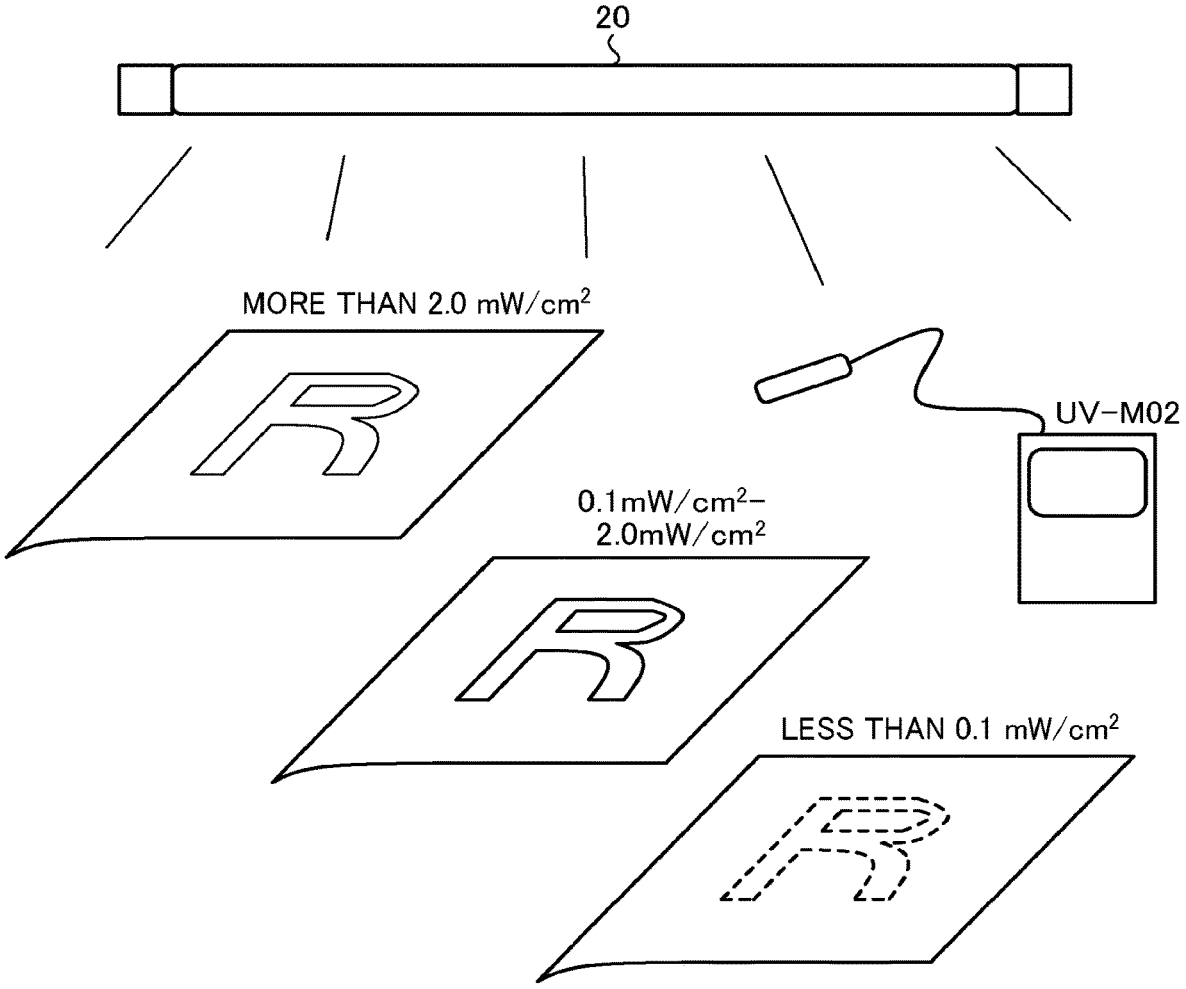
FIG. 4 is a schematic diagram illustrating a state in which illuminance of a fluorescent lamp type blue black light according to Example 2 is measured.

As illustrated in FIG. 4, the ultraviolet-excited fluorescent ink image was irradiated with fluorescent lamp type blue black light 20 separated from the ultraviolet-excited fluorescent ink image by a predetermined distance, and the illuminance at this time was measured with an ultraviolet illuminometer UV-M02 manufactured by Oak Manufacturing Co., Ltd. The measurement wavelength peak of the ultraviolet illuminometer UV-M02 was 360 nm.

As a result of the measurement, when the illuminance of the ultraviolet light was less than 0.1 $mW/cm^2$, it was difficult to perceive a difference in output color and color omission by visual check. It has been found that a difference in output color and color omission are easily checked visually when the illuminance of ultraviolet light is not less than 0.1 mW/cm$^2$. However, when the illuminance of ultraviolet light exceeds 2.0 mW/cm$^2$, the image is perceived as dazzling, and it is difficult to perceive color omission. In addition, a color tone sometimes looked different due to the high light emission luminance of the image.

From the above, it has been found that the illuminance of ultraviolet light at the time of visually judging the color and the color omission of an image printed with the ultraviolet-excited fluorescent ink is not less than 0.1 mW/cm$^2$ and not more than 2.0 mW/cm$^2$, as measured by an ultraviolet illuminometer having a measurement wavelength peak of 360 nm. Actually, since the printed image is checked in a relatively dark space in the liquid discharge apparatus, it is considered that the illuminance of ultraviolet light is more suitably not less than 0.5 mW/cm$^2$ and not more than 2.0 mW/cm$^2$.

Example 3

When an image on a printing sheet in the liquid discharge apparatus is visually checked, safety measures are required such that an operator does not touch a mechanically operating unit of the liquid discharge apparatus such as a carriage that moves left and right at high speed. For this purpose, it is conceivable to dispose a window made of a transparent resin in the liquid discharge apparatus such that the window functions as a safety cover.

In addition, such a window made of a transparent resin needs to block ultraviolet light which may cause skin tanning, spots, and wrinkles and may have an adverse effect on the eyes such that an operator is not exposed to the ultraviolet light even if the operator keeps closely watching a printing state.

The present inventor has studied polypropylene, polyethylene terephthalate, polystyrene, polycarbonate, and polymethyl methacrylate, which are generally widely used as materials of a window made of a transparent resin. Specifically, a transparent resin made of any one of these materials was irradiated with ultraviolet light from an ultraviolet irradiation light source, and the illuminance of the ultraviolet light after the ultraviolet light passed through the transparent resin was measured with an ultraviolet illuminometer UV-M02 manufactured by Oak Manufacturing Co., Ltd. As a result, polycarbonate and polymethyl methacrylate exhibited a blocking effect of 95% or more against ultraviolet light having a wavelength of 350 nm to 380 nm.

Example 4

In a printing technique using the ultraviolet-excited fluorescent ink, as described above, simply by replacing the ink based on three primary colors with the ink based on three primary colors of light, and performing a printing process using a negatively-inverted original image, basically, the same color as the original image before the negative inversion can be reproduced. However, in many cases, print output cannot be performed in such a color as desired for the original image simply by performing the negative inversion. In these cases, image processing adjustment is actually required. In these cases, correction is made while an output image is checked.

However, when such a correction operation is performed, since an image output from the liquid discharge apparatus is substantially invisible under visible light, an operation of separately emitting ultraviolet excitation light and checking the image is repeatedly performed. As a result, an expensive ink, a printing sheet for testing, and time may be wasted.

The present inventor applied the configuration of the liquid discharge apparatus 3 of the above-described embodiment to an 1PSiOGXe5500 manufactured by Ricoh Company Ltd., and performed image processing adjustment on a predetermined output image. Specifically, on the Ricoh IPSiOGXe5500 manufactured by Ricoh Company Ltd., a plurality of ultraviolet light irradiation LEDs arranged in a ribbon shape and a window made of polymethyl methacrylate having higher transparency were installed. In the case of the IPSiOGXe5500 manufactured by Ricoh Company Ltd., a distance between a carriage and a top plate is about 1 cm. By arranging the ultraviolet light irradiation LEDs in a ribbon shape, the thickness of such a configuration can be suppressed to 7 mm, and the ultraviolet light irradiation LEDs can be installed in the actual apparatus. The cyan ink was replaced with an ultraviolet-excited fluorescent light emitting red ink, the magenta ink was replaced with an ultraviolet-excited fluorescent light emitting green ink, and the yellow ink was replaced with an ultraviolet-excited fluorescent light emitting blue ink.

In order to quantify color evaluation, data measured using a light-shielding cylinder type colorimeter 52002 manufactured by Yokogawa Instruments Co., Ltd. is represented in a CIE1976L*a*b* color system. The color system is one of methods for expressing a color, and represents a color quantitatively and systematically. Among the methods, the CIE1976L*a*b* color system is a color system standardized by the International Commission on Illumination (CIE) in 1976. Lightness is represented by L*, and hue and saturation are represented by a* and b*. a * indicates a red direction, −a* indicates a green direction, b* indicates a yellow direction, and −b* indicates a blue direction.

Figure 5A:
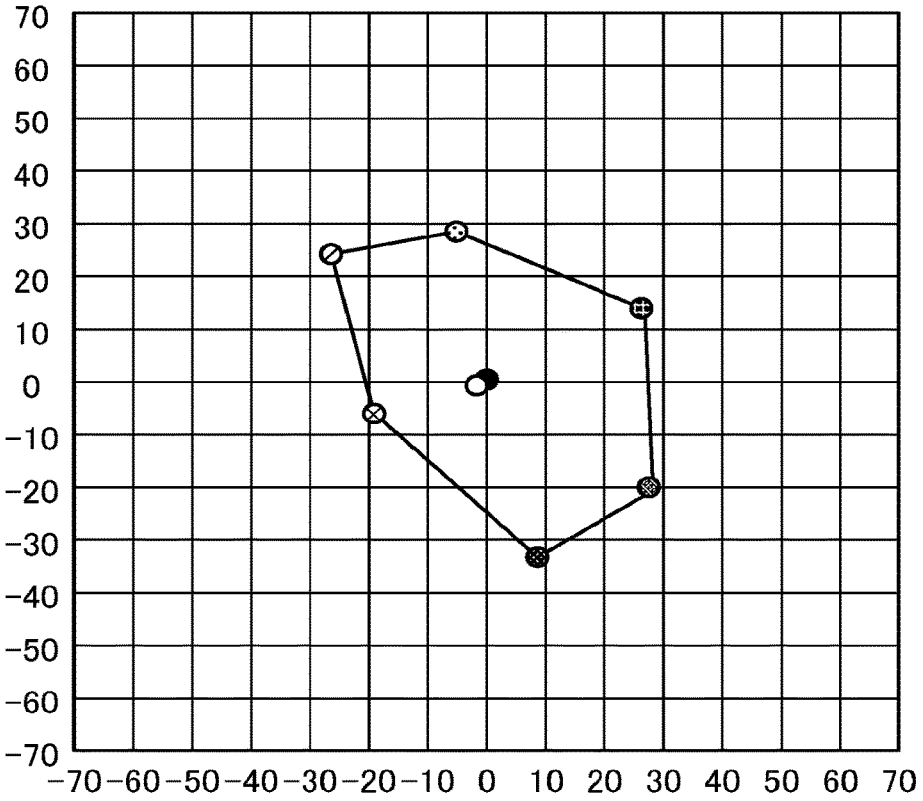
FIGS. 5A to 5C are diagrams in which history of image processing adjustment according to Example 4 is represented in a CIE1976L*a*b* color system.
Figure 5B:
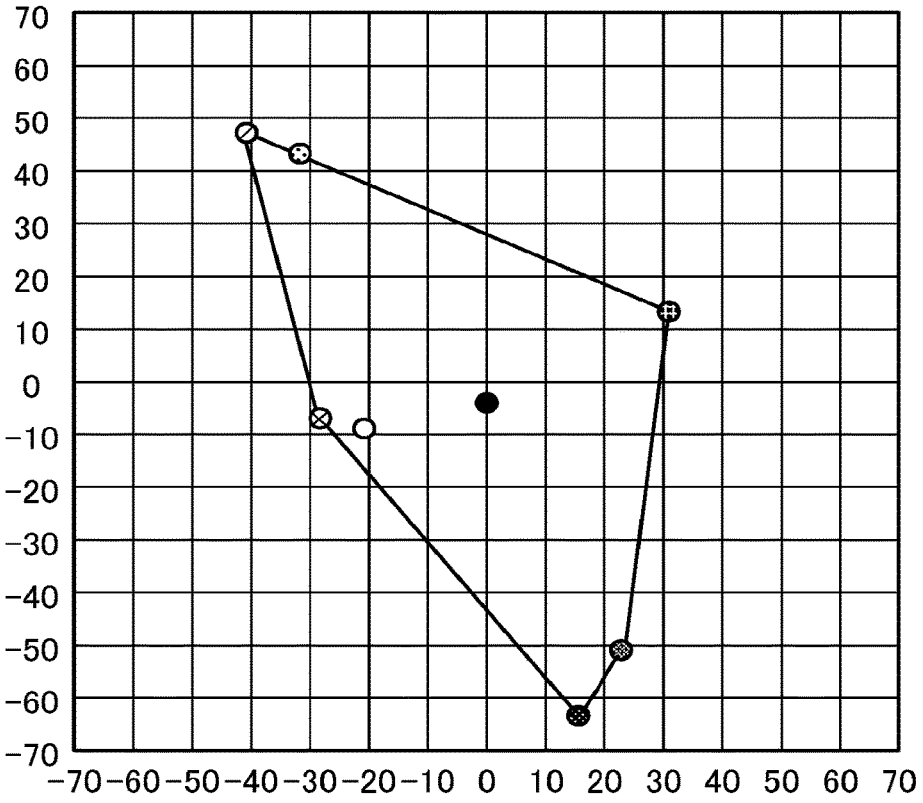
Figure 5C:
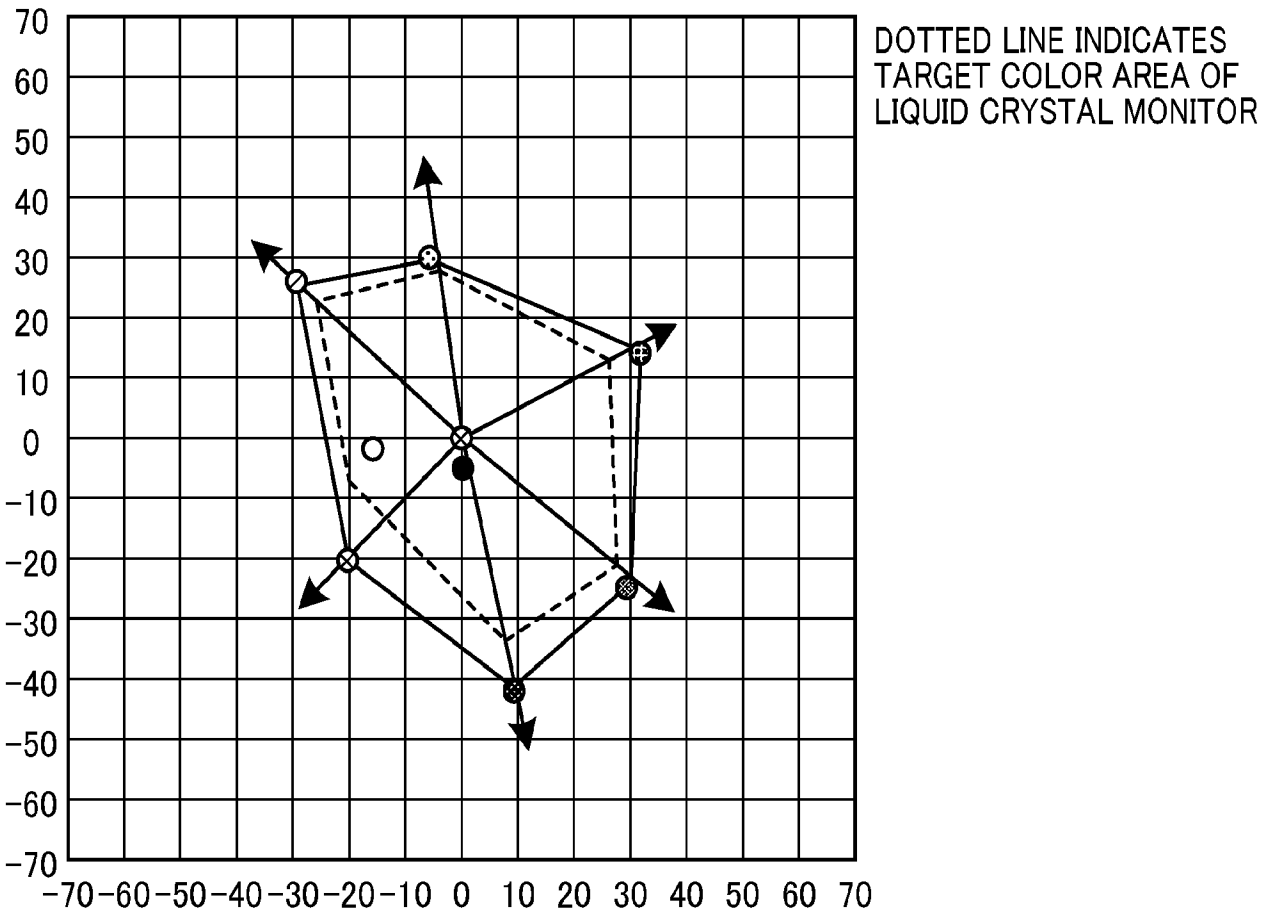

FIGS. 5A to 5C are diagrams in which history of image processing adjustment according to Example 4 is represented in the CIE1976L*a*b* color system.

As illustrated in FIG. 5A, first, six colors of CMYKRGB displayed on a liquid crystal monitor were measured using the light-shielding cylinder type colorimeter 52002, and the results were represented in the CIE1976L*a*b* color system. As a result, the coordinates of the colors and a target value of saturation, which is a distance from the center point, were obtained on the a*b* plane. The obtained distribution of the colors was hexagonal.

Next, the six colors of CMYKRGB displayed on the liquid crystal monitor were negatively inverted using image processing software, and then output in an inkjet manner by the above IPSiOGXe5500 manufactured by Ricoh Company Ltd. The fluorescent light type blue black light FL20BLB manufactured by Toshiba Lighting & Technology Corporation was brought close to the image, and the image was irradiated with ultraviolet light having a main wavelength of 365 nm. FIG. 5B illustrates a result obtained by measuring the image using the light-shielding cylinder type colorimeter 52002 and evaluating the image in the CIE1976L*a*b* color system.

As illustrated in FIG. 5B, the hexagonal coordinate distribution as illustrated in FIG. 5A was not obtained simply by the negatively inverting process.

Thereafter, an image printed by the IPSiOGXe5500 was irradiated with ultraviolet light by the plurality of ultraviolet light irradiation LEDs arranged in a ribbon shape, and various image processing adjustments were performed while visual check was performed through a window made of polymethyl methacrylate. FIG. 5C illustrates the CIE1976L*a*b* color system of an image obtained as a result of the image processing adjustments.

As illustrated in FIG. 5C, as a result of the various image processing adjustments, a light emission output image having a saturation exceeding display on the liquid crystal monitor was obtained.

In the image processing adjustment as described above, by using the IPSiOGXe5500 manufactured by Ricoh Company Ltd. to which the configuration of the liquid discharge apparatus 3 of the above-described embodiment was applied, consumption of the ultraviolet-excited fluorescent ink and a printing sheet for testing was suppressed.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A liquid discharge apparatus comprising:

a liquid discharge head to discharge a liquid onto a recording medium to form an image; and a window near the liquid discharge head and through which the image on the recording medium is visually recognizable.

2. The liquid discharge apparatus according to claim 1, further comprising an ultraviolet irradiation light source near the liquid discharge head, to irradiate the image with ultraviolet light, wherein the ultraviolet irradiation light source is disposed, and the liquid discharge head discharges an ultraviolet-excited fluorescent ink.

3. The liquid discharge apparatus according to claim 2, wherein the window comprises a transparent resin transmitting visible light and blocking ultraviolet light.

4. The liquid discharge apparatus according to claim 2, wherein the window comprises polycarbonate or polymethyl methacrylate.

5. The liquid discharge apparatus according to claim 2, wherein the ultraviolet irradiation light source irradiates ultraviolet light within a range of not less than 315 nm and not more than 400 nm.

6. The liquid discharge apparatus according to claim 2, wherein the ultraviolet irradiation light source irradiates the recording medium with ultraviolet light at an illuminance of not less than 0.1 $mW/cm^2$ and not more than 2.0 $mW/cm^2$, as measured by an ultraviolet illuminometer having a measurement wavelength peak of 360 nm.

7. The liquid discharge apparatus according to claim 2, wherein the ultraviolet irradiation light source has a ribbon shape in which a plurality of light emitting diodes to emit ultraviolet light is arranged.

8. The liquid discharge apparatus according to claim 1, wherein the liquid discharge head includes a first liquid discharge head, a second liquid discharge head, and a third liquid discharge head to discharge ultraviolet-excited fluorescent inks of three primary colors of light, respectively.

* * * * *